US007210384B2

(12) United States Patent
Elynuik

(10) Patent No.: US 7,210,384 B2
(45) Date of Patent: May 1, 2007

(54) SLUG PULLING PREVENTING TOOLING DIE

(75) Inventor: Morris Elynuik, Regina (CA)

(73) Assignee: Degelman Industries Ltd., Regina, Saskatchewan (CA)

( * ) Notice: Subject to any disclaimer, the term of this patent is extended or adjusted under 35 U.S.C. 154(b) by 224 days.

(21) Appl. No.: 10/755,999

(22) Filed: Jan. 13, 2004

(65) Prior Publication Data

US 2005/0150338 A1 Jul. 14, 2005

(51) Int. Cl.
*B26F 1/14* (2006.01)

(52) U.S. Cl. ..... 83/166; 83/685; 83/690

(58) Field of Classification Search ..... 83/164, 83/166, 685, 690; 76/107.1
See application file for complete search history.

(56) References Cited

U.S. PATENT DOCUMENTS

| | | | | | |
|---|---|---|---|---|---|
| 711,752 | A * | 10/1902 | Arnold | 83/685 |
| 1,288,054 | A * | 12/1918 | Lane | 83/690 |
| 2,708,970 | A * | 5/1955 | Taylor | 83/637 |
| 3,358,538 | A * | 12/1967 | Maceyka | 83/164 |
| 3,710,666 | A * | 1/1973 | Keyes et al. | 83/690 |
| 3,779,113 | A * | 12/1973 | Jestin | 83/698.91 |
| 3,779,122 | A * | 12/1973 | Sawvell | 83/698.91 |
| 4,516,450 | A * | 5/1985 | Shuttleworth | 83/345 |
| 4,543,865 | A * | 10/1985 | Kramski | 83/690 |
| 4,947,720 | A * | 8/1990 | Howe | 83/685 |
| 5,417,133 | A * | 5/1995 | Bakermans et al. | 83/166 |
| 5,957,024 | A * | 9/1999 | Kuwabara | 83/685 |
| 6,508,155 | B1 * | 1/2003 | Phlipot | 83/684 |
| 6,968,763 | B2 * | 11/2005 | Chapin et al. | 83/164 |
| 2004/0216577 | A1 * | 11/2004 | McCrudden | 83/684 |
| 2006/0112798 | A1 * | 6/2006 | Rensen et al. | 83/13 |

OTHER PUBLICATIONS

J & L Industrial Supply™ catalog, Nov. 2004.*
http://www.manufacturingcenter.com/tooling/archives/0200/0200slg.asp.
http://www.amada.co.uk/Tooling/Q&A/SlugPull.htm.
http://www.itida.com/tpp_tools/sldie_tail.html.
http://www.finnpower.com/finnishline/Volume12_Issue01/focus_on_tooling_wilson.html.
"Slug Guard", Tooling Options, p. 3.
Brolund, Ted, "Determining punch problems", http://www.thefabricator.com/xp/Fabricator/Articles/Fabricating/Article243/Article243_p1 (web page), © 2003, The Croydon Group, Ltd., pp. 1-4.
Tarkany, Nick, "Improving perforating die performance", http://www.thefabricator.com/xp/Fabricator/Articles/Stamping/Stamp03/03web176.xml, (web page) © 2003, The Croydon Group, Ltd., pp. 1-4.

(Continued)

*Primary Examiner*—Jason Prone
(74) *Attorney, Agent, or Firm*—Davis Bujold Daniels, P.L.L.C.

(57) ABSTRACT

A punch and die tooling apparatus commonly used by metal fabricators for creating holes, passages and cavities in metal plate, the die having a unique internal bore which relieves the problem of slug pulling to ensure that a slug punched out of a metal sheet is not retained on the punch face to interfere with further operation of the apparatus. The die is provided with a substantially horizontal ridge and a corresponding horizontal land and relief space formed within the bore to facilitate tipping of the slug relative to the punch and thereby break any attachment between the slug and the punch face which causes slug pulling.

4 Claims, 8 Drawing Sheets

OTHER PUBLICATIONS

Baeumler, Frank, "Keeping pace with today's punching requirements", http://www.thefabricator.com/xp/Fabricator/Articles/Fabricating/Article291/Article291_p1.xml, (web page) © 2003, The Croydon Group, Ltd., pp. 1-4.

Better Production; "Tooling Provides Productivity and Technological Advantages", http://www.mmsonline.com/articles/0601bp1.html, (web page) 2001 All Rights Reserved, pp. 1-2.

Oberg Industries, "Slug Retention", http://www.carbide-steel-stamping-die-components-monitoring-control.com/slugretention.html, (web page), Oct. 29, 2003, pp. 1-2.

Dayton Progress Corporation, "Dayton Slug Control System", © 1996 Dayton Progress Corporation, pp. 1-3.

Impax Division of Wilson Tool, Inc., "Impax™ Introduces Slug Pulling Solution to the Stamping Industry", *Tooling Solutions*, vol. 3, No. 2, © 2000, Impax™, pp. 1-2.

Impax Division of Wilson Tool, Inc., "Introducing New Ball Lock Tru Advantage™ & Special Retainers", Impax™, pp. 1-2.

Oberg Industries, "Reduce Excessive Manufacturing Costs Assocaited With Slug Pulling in Your Stamping Operations", © 2003 Oberg Industries, pp. 1-2.

Mate Precision Tooling, "MT™ Tooling", part numbers list, Rev. Oct. 2001, © 2001 Mate Precision Tooling, pp. 1-3.

Scott, B. and W. A. Whitney, Whitney Dies, pp. 1.

* cited by examiner

SLUG PULLING PREVENTING TOOLING DIE

FIELD OF THE INVENTION

The present invention relates to a punch and die tooling apparatus commonly used by metal fabricators for creating holes, passages and cavities in metal plate. In particular, the present invention relates to a die for such an apparatus having a unique internal bore which relieves the problem of slug pulling, i.e. ensures that a slug punched out of a metal sheet is not retained on the punch face to interfere with further operation of the apparatus. More specifically, the die is provided with a substantially horizontal ridge and a corresponding horizontal land and relief space formed within the bore to facilitates tipping of the slug relative to the punch and thereby break any attachment between the slug and the punch face which causes slug pulling.

BACKGROUND OF THE INVENTION

Punch and dies have been used for decades by metal fabricators as a common process for creating holes in metal plate. The die usually has a surface and above defining a cutting edge upon which the metal plate is positioned. The male punch element which, moves generally perpendicular relative to the female die and metal plate thereon, is concentrically aligned with the die bore. The punch is pressed through the steel plate and into the bore, creating a hole in the plate and cutting a slug from the metal plate material. The slug should either be frictionally retained inside the die or the slug should drop off the punch face so the punch can recycle to produce another hole and slug in a subsequent cycle of the punch press.

Slug retention or slug pulling as it is commonly known is a significant problem with such tool and die apparatus. Slug pulling will cause machine down time as well as material, tool and machine damage. Slug pulling occurs when the slug does not separate from the punch face, but actually gets pulled fully or partially up by the punch and out of the die as the punch cycles on an up-stroke. A number of factors can cause slug pulling. A lubricant is usually used to reduce wear and keep the punch and die sets in good condition as well as to reduce the tonnage required to punch a hole. These lubricants can create a vacuum effect between the flat face of the punch and the top of the slug. Lighter oils i.e. generally oils of lower viscosity, may reduce the vacuum effect to some extent, but slug pulling still occurs. Furthermore, lighter oils vaporize and are messy. Also, as the punch begins to wear, a raised butt is created on top of the slug that can "hug" or wrap itself around the punch adhering to the punch to cause slug pulling. It is also possible for the punch to become magnetized, thus causing an undesired adherence of the slug to the slug face.

Tool and die manufacturer's solutions generally use the concept of trying to retain the slug in the die by use of friction. By way of example, if the slug is squeezed in the bore hole of the die tight enough, the slug friction will be greater than the vacuum between the slug and the punch face on the up stroke of the punch cycle. Known friction die add internal vertical ridges or slightly off vertical ridges on the walls of the die bore, i.e., ridges or ribs which run substantially parallel with the longitudinal axis of the bore hole. Other known devices utilize protrusions in the bore, for example a tapered pressure point or points. None of these solutions have been shown to be particularly effective as slug pulling can still occur, and as the internal ridges or pressure points wear, the slug pulling problem gets worse.

SUMMARY OF THE INVENTION

Wherefore, it is an object of the present invention to eliminate the problem of slug retention and slug pulling by punch and die machines when creating holes in metal plate.

Another object of the present invention is to provide a partially circumferential ridge and a relief area formed substantially horizontally relative to the longitudinal axis of the die bore in order to facilitate the elimination of slug retention by the punch.

A still further object of the present invention is to form the ridge and land by providing partially offset die bores or non-concentrically machined top and bottom die bores.

A yet still further object of the present invention is to provide such an offset bore by forming a lower bore section which is slightly larger in diameter and offset from the center longitudinal axis of a top bore section formed in the die.

A still further object of the present invention is to initially form the larger diameter offset lower bore section and then form the slightly smaller top bore to overlap the lower bore section and create a relative longitudinal spacing between the ridge area and the relief area that forces the slug to deflect or tilt thereby breaking any bond between the slug and a face of the tooling punch.

Another object of the present invention is to eliminate slug pulling and slug retention by providing a long lasting, wear resistant die which is economical and can be easily mass produced and that the performance of the die with respect to elimination of slug pulling is heightened the more that the die is used due to wear off the sharp edges formed by the offset die bores.

The present invention also relates to a die for a punch and die tooling apparatus comprising a die body defining a through bore extending between a top and a bottom surface of the die body, the through bore further comprising an upper bore defining a cutting edge on the top surface of the die body and extending partially through the die along a first longitudinal axis, a lower bore defining a bottom opening on the bottom surface of the die and extending partially through the die along a second longitudinal axis to connect with the top bore, wherein the second longitudinal axis is parallel to and offset from the first axis to form a first and a second opposing ledges at an intersection of the upper and lower bores in the through bore.

The present invention also relates to a method of forming a die for a punch and die tooling machine comprising the steps of forming a through bore in a die body extending between a top and a bottom surface of the die body, the formation of the through bore further comprising the steps of machining a lower bore in the die body to define a bottom opening on the bottom surface of the die and extending partially through the die along a second longitudinal axis parallel to and offset from the first axis, machining an upper bore in the die body to define a cutting edge on the top surface of the die body and extending partially through the die along a first longitudinal axis to connect the upper bore and the lower bore, and overlapping the upper bore with the lower bore to create a first and a second opposing ledges at an intersection of the upper and lower bores within the through bore.

BRIEF DESCRIPTION OF THE DRAWINGS

The invention will now be described, by way of example, with reference to the accompanying drawings in which.

DETAILED DESCRIPTION OF THE INVENTION

Figure 1:
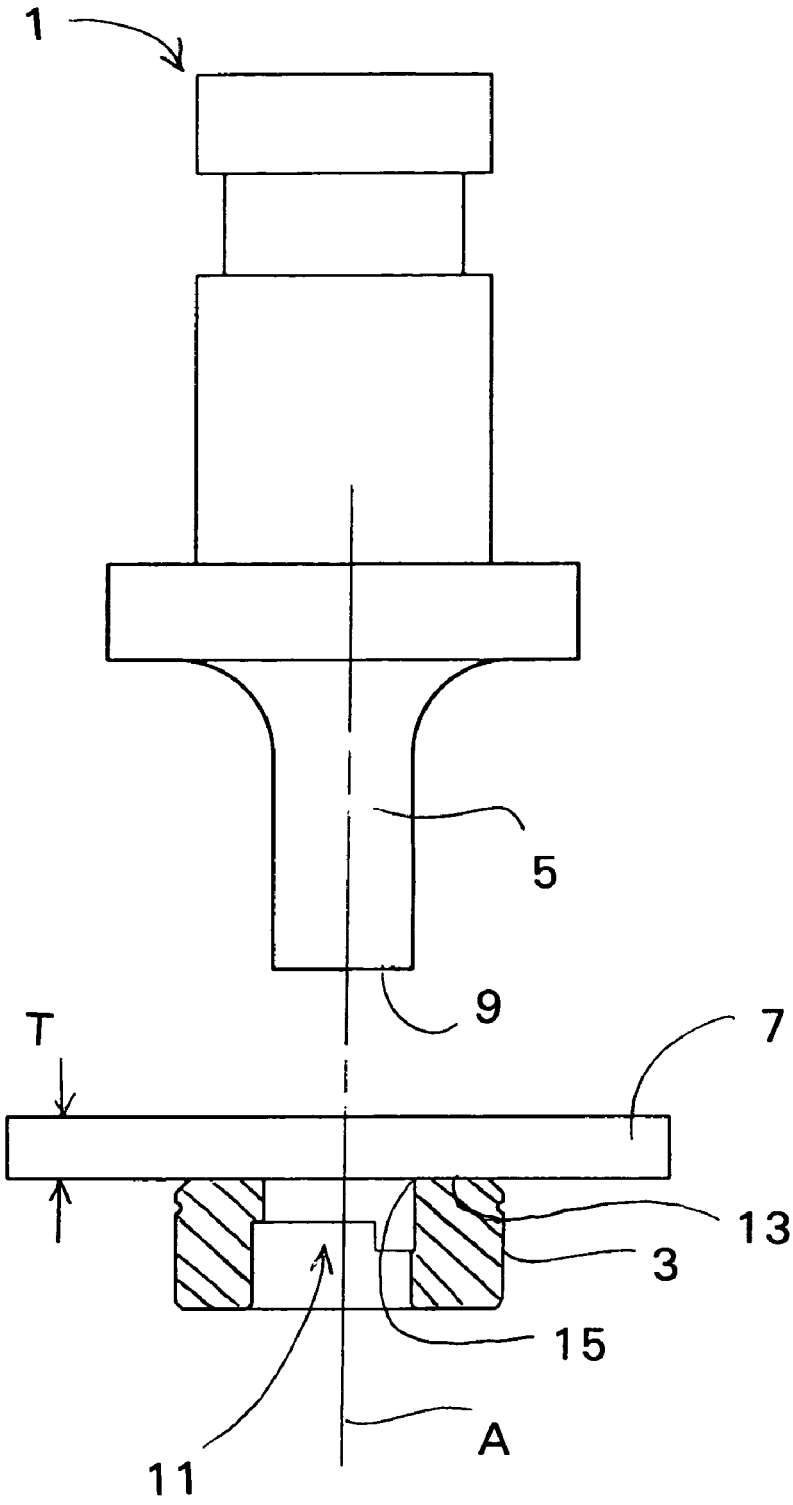
FIG. 1 is an elevation view of a punch, die and metal sheet prior to hole formation.

A punch and die machine, as well known in the art, is provided with a punch and a die for forming holes in metal plate. Observing FIG. 1, a punch 1 is shown positioned above, and relatively spaced above a die 3 and metal plate 7. The punch 1 is provided with a point 5 extending downward to define a longitudinal axis A along which the punch 1 generally travels in a substantially vertical, or up and down motion. The point 5 has a diameter which is substantially the same size as a hole to be formed in the metal plate 7, and at a free end of the point 5 a substantially flat, horizontally aligned and relatively flat face 9 is formed to directly contact and cut the metal plate 7.

The die 3 is positioned generally below the punch 1, and the die bore 11 is provided with a diameter which is at least slightly larger than the point 5 of the punch 1 to permit the face 9 and point 5 to penetrate into the die bore 11 along the longitudinal axis A. As is well understood by those in the art, the depth to which the punch 1 is permitted to penetrate the die bore 11 can be controlled by mechanisms on the punch and die apparatus and, therefore, may be set to any desired depth often dependent upon the thickness of the steel plate being cut. The metal plate 7 has a particular thickness T and is positioned between the punch 1 and the die 3 and generally perpendicular to the axis A along which the punch 1 and die 3 are aligned. The plate 7 is positioned on a top surface 13 of the die 3 which defines a top cutting edge 15 formed where the die bore 11 intersects the top surface 13.

Figure 2:
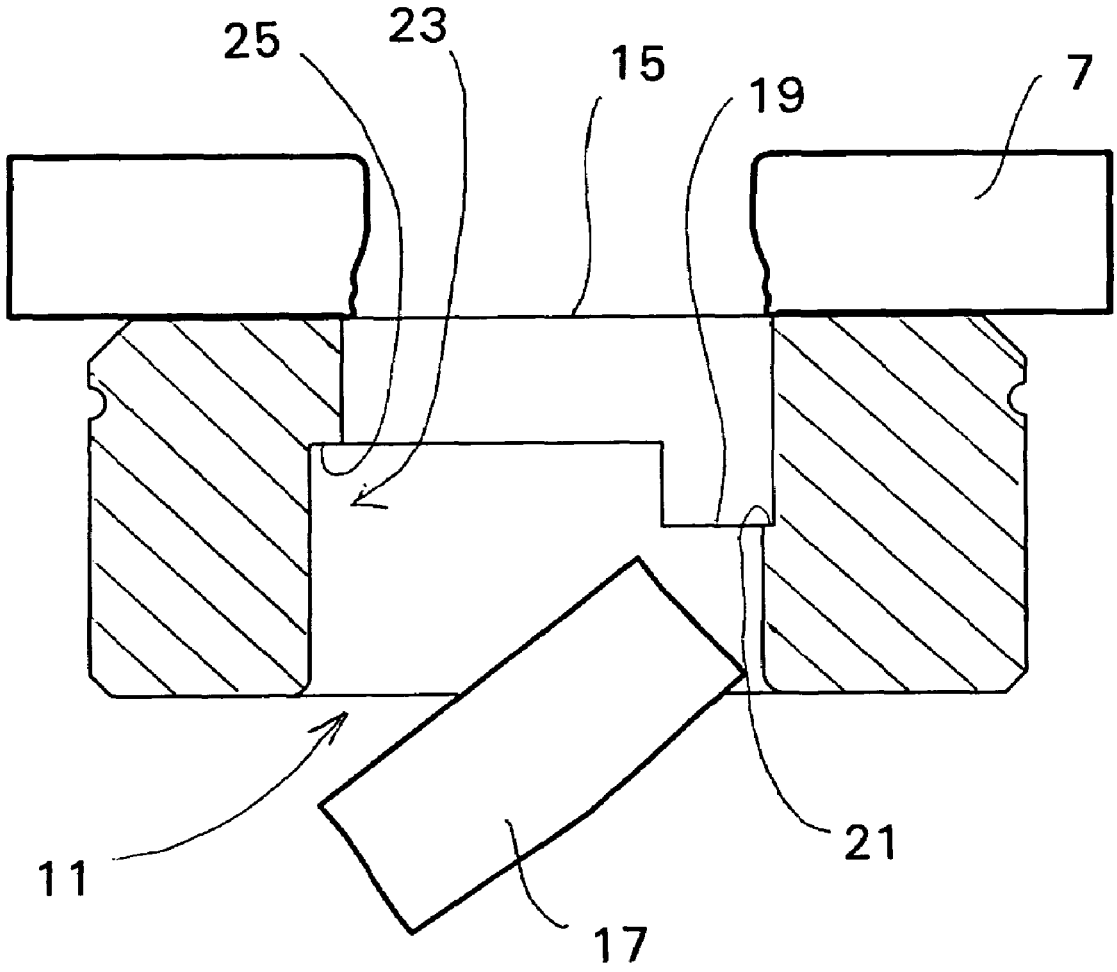
FIG. 2 is a cutaway elevation view of the tooling die of the present invention a metal plate, and a slug cut from the metal plate.

Turning to FIG. 2, a slug 17, having been cut by the punch 1 (not shown here), is shown passing through the die bore 11. In order to eliminate the slug pulling and slug retention as discussed in the Background of the Invention, the die bore 11 is formed in a unique manner to cause the slug 17, during cycling of the punch 1 through the metal plate 7, to tip relative to the horizontal face 9 of the punch 1, thus breaking any bond between the slug 17 and the face 9 of the punch 1. To accomplish this relative tipping of the slug 17, a further discussion of which will be provided below, a substantially horizontal ridge 19 or ledge is created in a wall of the die bore 11. The ridge 19 forms a substantially horizontal, upwardly facing ridge surface 21 aligned-perpendicular to the longitudinal axis A and relative vertical path of the slug 17 through the die bore 11.

Substantially opposite to the ridge surface 21 in the die bore 11, in other words on the opposite side of the die bore wall, approximately 180 degrees from the ridge 19, a relief 23 is partially circumferentially formed in the die wall. The relief 23 is defined by a substantially horizontally and downward facing relief surface 25 relative to the downward path of the slug 17.

Figure 3A:
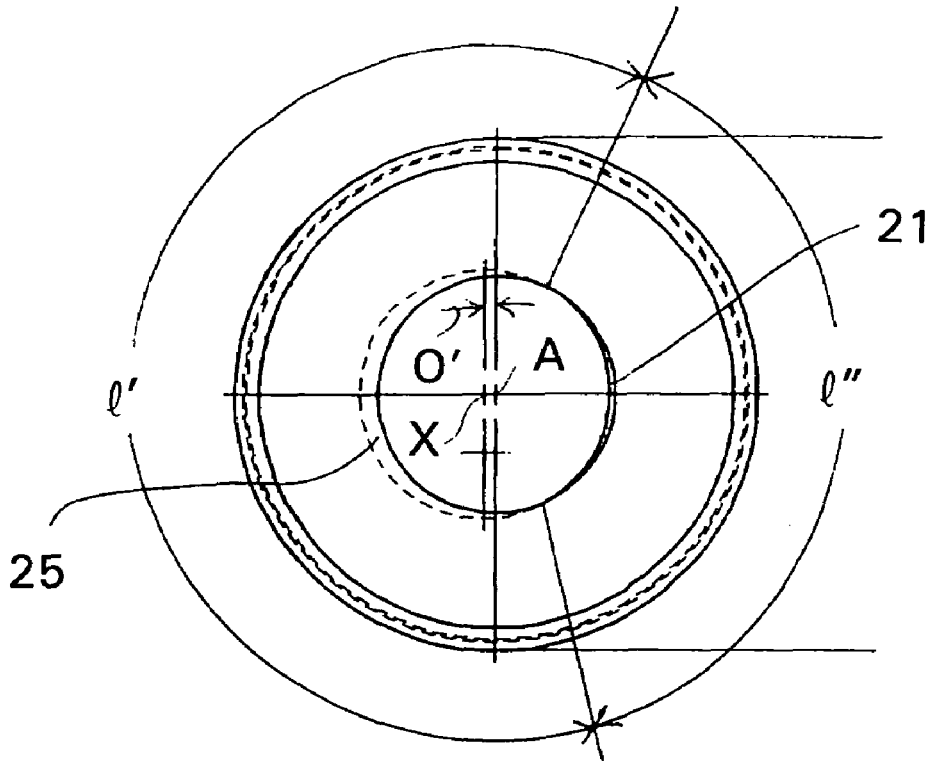
FIG. 3*a–b* are respective top and bottom plan views of the tooling die.
Figure 3B:
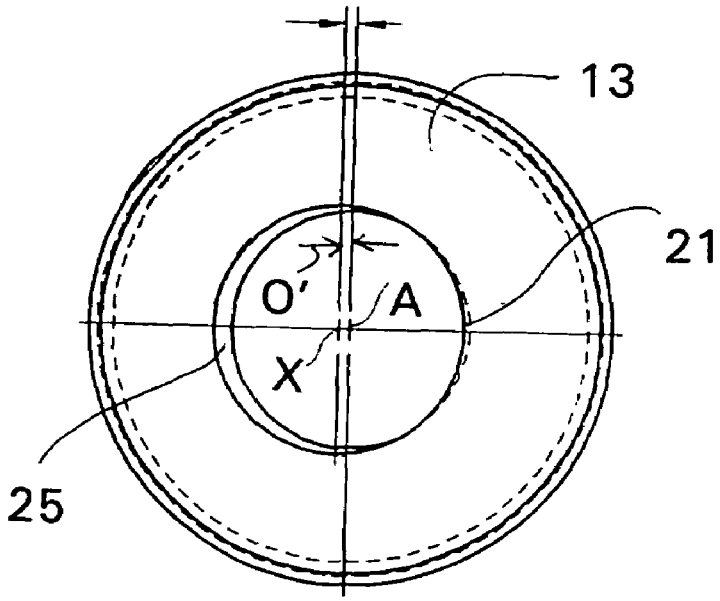
Figure 4A:
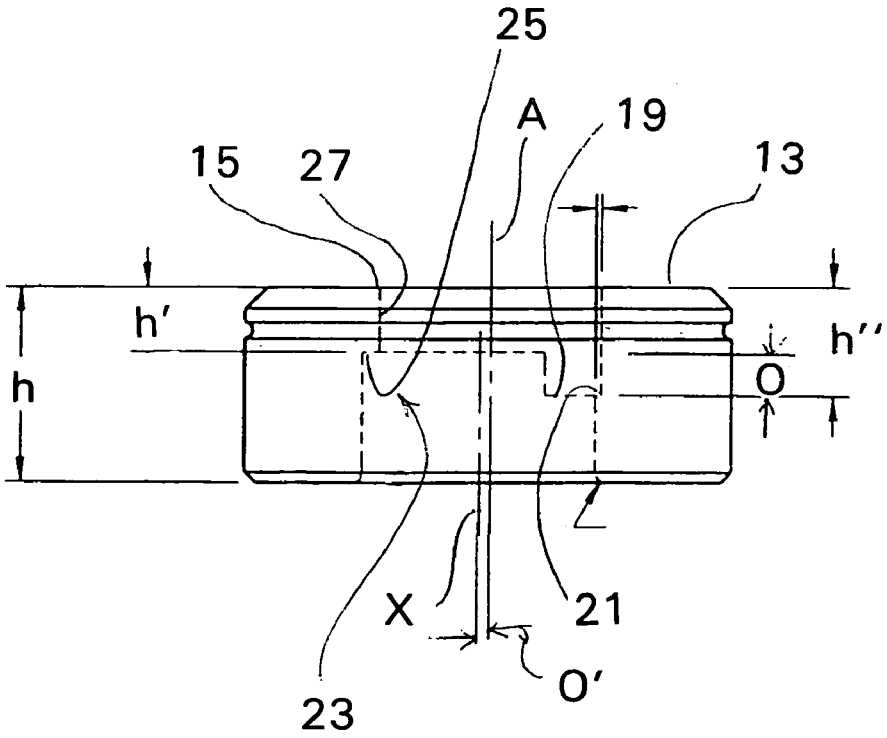
FIG. 4*a–b* are side and cross-sectional side views respectively of the die.

Observing FIGS. 3*a–b* and 4*a–b*, the relief surface 25 also is usually provided with a longer radial length l' than a radial length l" of the ridge surface 21 as seen in FIG. 3*a*, and is also longitudinally, i.e., axially spaced from the top surface 13 and cutting edge 15 of the die 3 a distance h' as seen in FIG. 4*a*. In addition, as shown in FIG. 4*a*, the relief surface 25 is generally formed higher on the wall of the die bore 11 than the ridge 19 and ridge surface 21, in other words, the downward facing relief surface 25 is longitudinally or axially positioned between the cutting edge 15 of the die 3, and the slug tipping ridge surface 21 to permit the top edge portion 33 of the slug 17 to tip from the horizontal and not jam against the inner wall of the die bore 11. The ridge 19 is longitudinally spaced from the top surface 13 and cutting edge 15 of the die 3 a distance h" and extends partially around the circumference of the wall of the die bore 11.

Figure 4B:
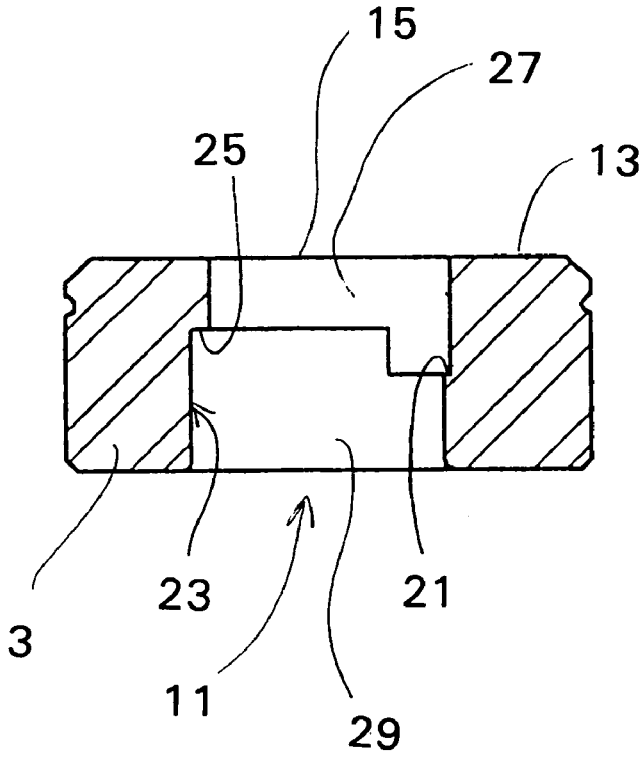

Another way of defining the die bore 11 of the present invention is that the die bore 11 itself is composed of a top bore 27 and an offset bottom bore 29. The top bore 27 extends down from the top surface 13 of the die 3 the distance h", and the bottom bore 29 extends upwards from the bottom surface 14 of the die 3 to the distance h' from the top surface 27. As can be seen in FIG. 4*a–b*, this results in a degree of overlap O of the top bore 27 and bottom bore 29. It is to be appreciated that this overlap O in combination with an offset O' as defined by the offset center axis X of bottom bore 29, to be discussed in further detail below, produce the ridge surface 21 and relief surface 25 discussed above.

In addition to the radial length l' of the downward facing relief surface 25 being longer than the radial length l" of the ridge surface 21, as seen in FIGS. 3*a–b*, the area of the downward facing relief surface 25 may be larger than the area of the upwardly facing ridge surface 21. This is an important aspect of the present invention as the relief surface 25, its radial length l' and the longitudinal spacing of the relief surface 25 from the opposing ridge surface 21 must define a relief area 23 in the die bore 11 which will permit the tipping of the slug 17 in the die bore 11 relative to the horizontal point face 9 and the longitudinal axes A, X when a bottom portion of the slug 17 encounters the ridge surface 21 causing the slug 17 to tip. Because the slug 17 is essentially cut to the same diameter as the top bore 27, the relief area 23 provides room for the slug 17 to be tipped relative to the longitudinal axes A, X within the die bore 11. This aspect of the present invention may be better achieved by the difference in respective diameters between the top bore 27 and bottom bore 29.

Turning to FIG. 5*a–d*, a description of the above discussed features of the present invention in conjunction with a downward cycle of the punch 1 and the forming of a hole in the steel plate 7 is provided.

Figure 5A:
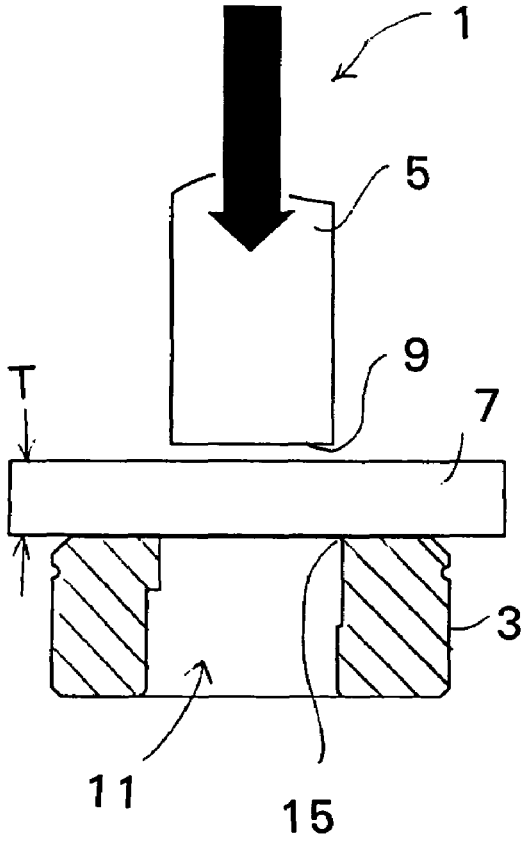
FIG. 5*a–d* are a sequence of punch an die cutting operations.
Figure 5B:
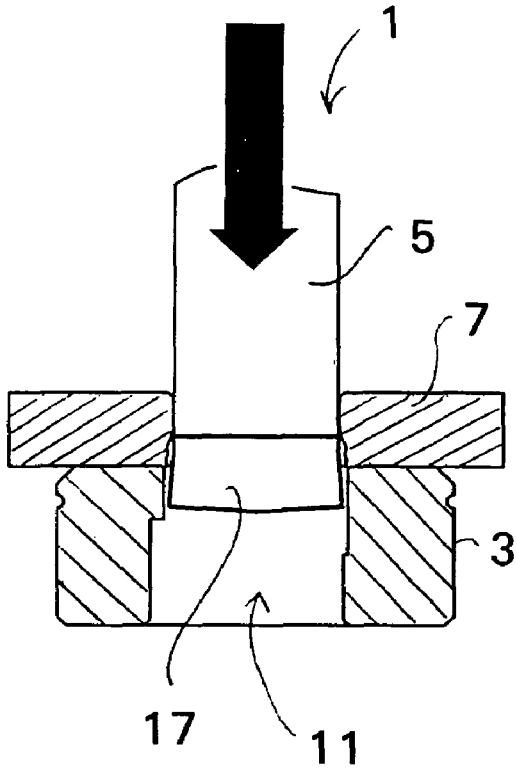
Figure 5C:
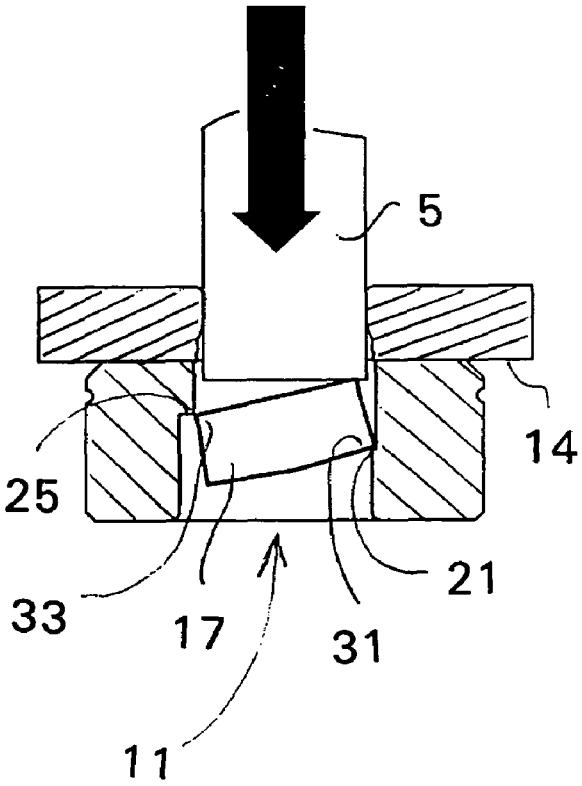

A metal plate 7 is positioned on the top surface 13 of the die and the punch 1 is driven downward along the axis A. In FIG. 5*b*, the punch face 9 has been brought downwards into contact with the metal plate 7, as shown by the arrow and, with the aid of the opposing cutting edge 15 on the top surface 13 of the die 3, cuts a slug 17 from the metal plate 7. The punch face 9, still being in contact with the slug 17, begins pushing the slug 17 into the die bore 11. FIG. 5*c* shows the punch point 5 and face 9 having pushed the slug 17 clear of a bottom surface 14 of the metal plate 7 and the punch face 9 having passed through the thickness T of the metal plate 7 to force a lower edge portion 31 of the slug 17 into contact with the ridge surface 21 in the die bore 11. The contact between the lower edge portion of the slug 31 and the upwardly facing ridge surface 21 causes a relative tipping of the slug 17 with respect to the axis A and the face of the punch 9.

As can be seen in FIG. 5*c*, the top surface of the slug 13 and the face 9 of the punch point 5 are caused to separate by the tipping action of the slug 17. In order to facilitate the tipping of the slug 17, and to ensure that the tipping of the slug 17 does not cause the slug 17 to become jammed in the die bore 11, the relief surface 25 and relief area 23 permit the top edge portion 33 of the slug 17 to pass under the relief surface 25 and rotate radially outward relative to the upper top bore 27. Thus, in view of the relief surface 25 and relief area 23 defined thereby, the slug 17 is permitted to tip freely relative to the horizontal nature of the point face 9 as it is cut from the metal plate 7.

Figure 5D:
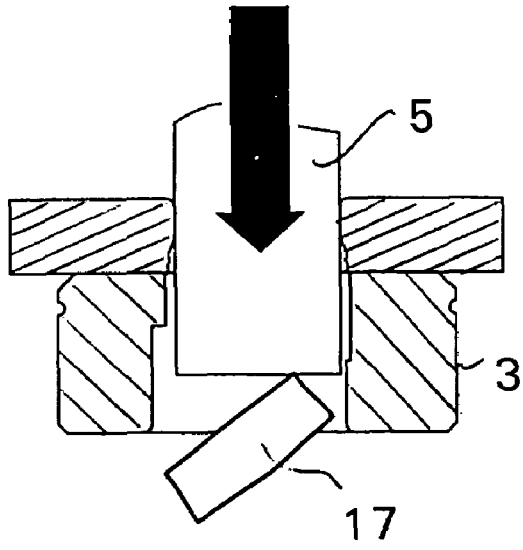

The relief area 23 permits the slug 17 to be tipped downwards by providing a larger wall clearance in a lower portion 29 of the die bore 11. FIG. 5*d* details the continued movement of the punch point 5 penetrating into the die 3 and pushing the slug 17 past the ridge 19 and relief surfaces 25 and out of the die 3. It is to be appreciated that as the top surface of the slug 13 is now tipped or angled with respect to the face 9 of the punch 1. With such separation, no seal or attachment of the slug 17 to the punch face 9 can occur from the relative viscosity of lubricant oils, nor should any type of molecular, magnetic or other bonding between the punch face 9 and the slug 17 also occur. The slug 17 then falls freely downward through the die 3 and away from the punch point 5 as the punch point 5 is returned to the initial starting position above the metal plate 7 and die 3. Thus the forced separation between the punch face 9 and the metal slug 17 substantially eliminates the possibility of slug pulling and thus the punch 1 can be cycled back to an initial raised position above the metal plate 7 and die 3 without a slug attached thereto.

It is to be appreciated that as the punch 1 comes down, i.e. is applied to the metal plate with the desired amount of tonnage necessary to cut the plate, a significant vacuum/suction or bond is often created between the slug 17 and the punch face 9. The initial contact with the ridge surface 21 as the bottom edge portion 31 of the slug 17 encounters the ridge surface 21 in the die bore 11 impedes the lower edge portion 31 of the slug causing, in most instances, the suction or bond to break and the slug 17 to tip. However, even if the bond or attachment is not completely broken, the slug 17 is forced radially over to the relief 23 or clearance side of the bottom die bore 29 upon hitting the ridge 19 and cannot be pulled back up because of the taper of the slug 17 as well as the fact that upon withdrawal of the punch point 5 from the die bore 11, the top edge portion 33 the slug 17 will encounter the downward facing relief surface 25 as it is pulled up, and thus the bond will be broken as the slug 17 is essentially shaved off the withdrawing punch face 9 as the punch 1 is cycled upwards out of the die bore 11.

Figure 6:
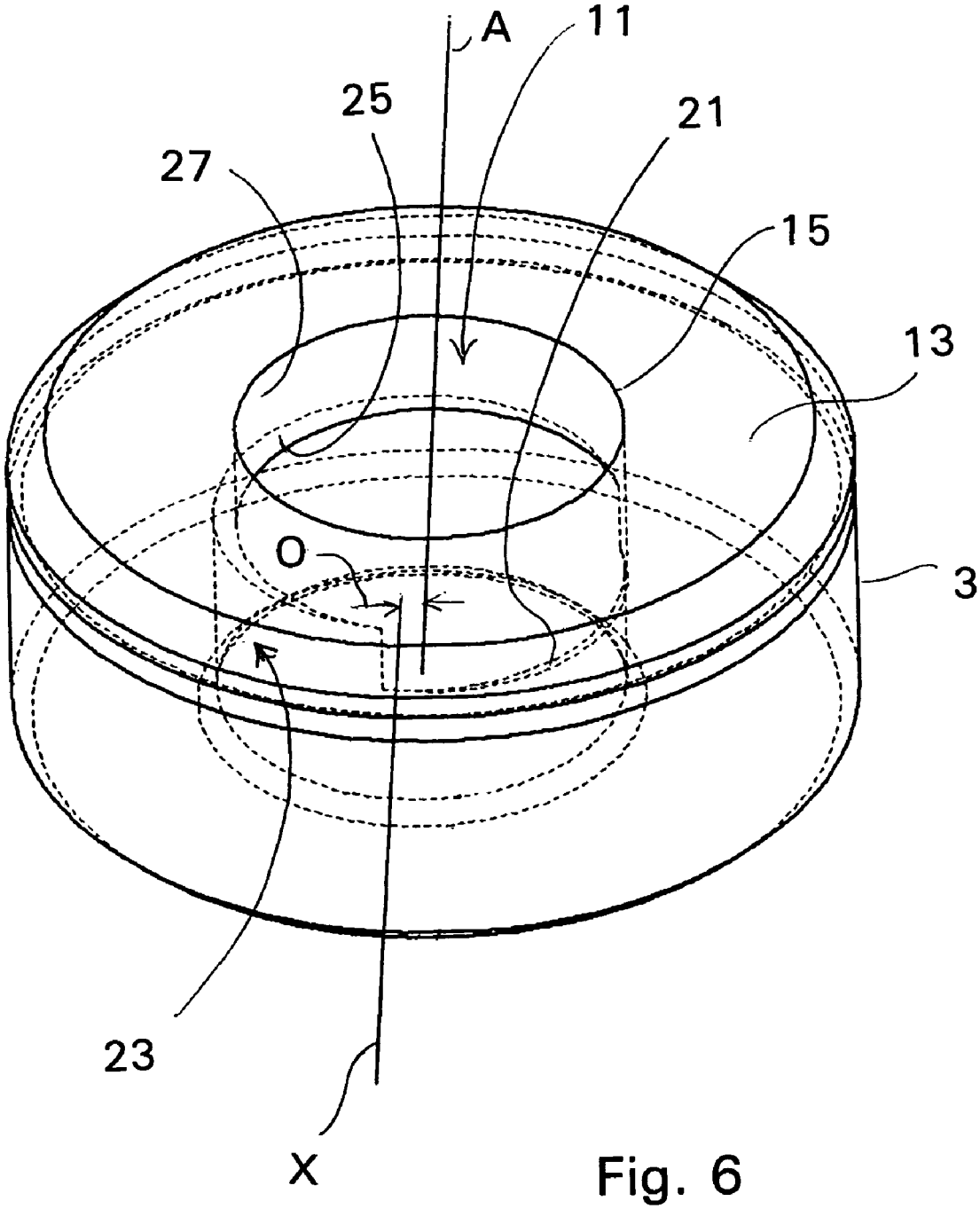
FIG. 6 is a perspective view of the die according to the present invention.

Turning to FIG. 6, a method for forming the ridge 19 and the relief 23 in the die 3, as shown here in perspective view, is now provided. The above discussed features may be formed in any number of ways or method as are known in the art. An example of a preferred method by which the ridge surface 21 and relief surface 25 may be formed in the die bore 11 is as follows. Provided with a blank die, i.e., merely a solid metal block having no hole or bore therethrough, the top bore center line, or longitudinal axis A determined by any method as well known in the art. With the center line A known and marked on the top surface 13 and bottom surface of the die blank, a second offset die bore axis X is determined at a desired offset O from the top bore centerline A, i.e., radially spaced therefrom.

With the offset die bore axis X marked on the bottom surface 14 of the die 3, the offset bottom bore 29 is first formed along the die bore axis X, by machining or drilling as known in the art, from the bottom surface 14 of the die 3 partially through the die to a distance h' from the top surface of the die 13.

The top portion 27 of the die bore 11 is then formed along the axis A, by machining or drilling usually, from the top surface 13 of the die 3 along the center line A of the top bore 27. The top bore 27 of the die bore 11 is machined from the top surface 13 of the die blank through to connect with and meet the bottom bore 29. Furthermore, the top bore 27 is machined a distance h" to overlap a distance O with the bottom bore 29. Because the top bore 27 is centered along the axis A at the center point of the die blank and overlaps the bottom bore 29, a first portion of the top bore 27 at the intersection with the lower bore 29 thus creates the overhang, or downwardly facing relief surface 25 on the wall of the die bore 11. A second portion of the top bore 27 does not intersect the lower die bore 29, but continues cutting through the die 3 opposite to the relief surface 25 to a desired depth even after the intersection of the top and bottom bores 27, 29, respectively, this continued cutting of the die 3 creates the upwardly facing ridge 19 surface at the depth h" where the top bore 27 essentially ends.

The top bore 27 is machined to a desired depth h" overlapping to a desired extent with the bottom bore 29 so that a complete passageway is formed through the die 3. Due to the offset nature of the top and bottom bore 27, 29, and the overlapping nature of the top and bottom bores 27, 29, as can be seen in FIG. 6, the upwardly facing ridge surface 19 is formed essentially where the top bore 27 machining process is stopped. The ridge 19 having an upward facing substantially horizontal surface 21 relative to the longitudinal axis A along which the punch 1 will operate. Because of the overlapping nature of the top and bottom bores 27, 29 the ridge surface 21 and the relief surface 25 are also longitudinally spaced apart, with the relief area 23 being formed substantially at the end of the bottom bore 29, and the ridge area 23 being formed at the upper end of the top bore 27 and the ridge area being formed at the lower end of the top bore 27 and radially opposite from the relief surface 25.

As is known in the art, the top die bore 11 can be any desired size depending on the holes to be formed in the metal plate 7. In particular, the top bore 27 is machined to be substantially the same size as the hole to be formed in the metal plate 7 and slightly larger than the diameter of the die punch face 9 and point 5 in order to accommodate the penetration of the punch 1 into the die 3. The diameter of the point 5 and face 9 of the punch 1 is also formed substantially the same size as the hole which is to be formed in the metal plate 7, but slightly smaller than the diameter of the top bore 27 so as to fit therein. As the bore 11 and punch point 5 diameters may vary in particular with any desired size of hole to be formed in a metal plate 7 as is well known in the art no further discussion is provided herein.

Figure 7A:
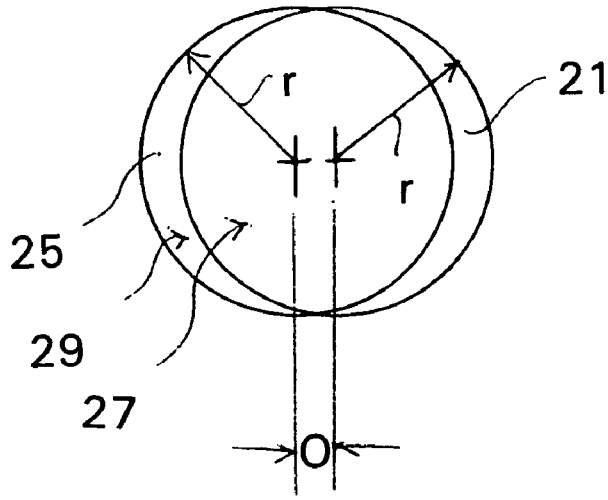
FIG. 7*a–b* are examples of similar and different diameter top and bottom offset axes.
Figure 7B:
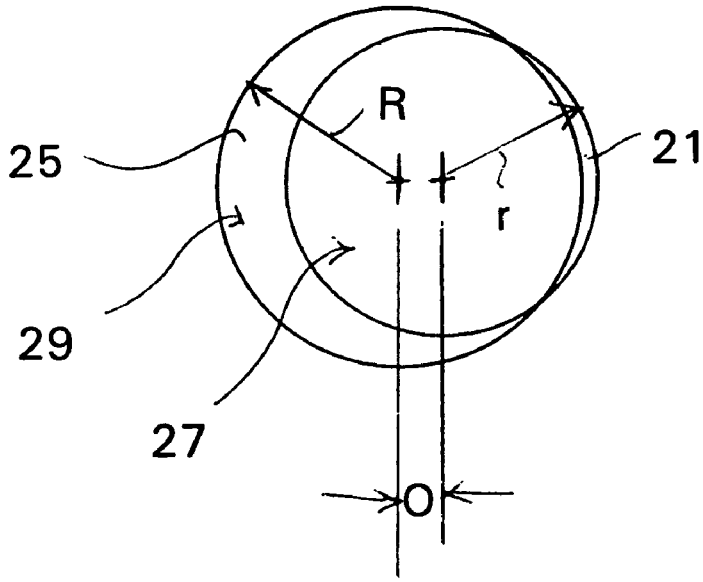

However, it is to appreciated that the relative diameters of the top bore 27 and bottom bore 29 forming the complete die bore 11, can be substantially the same as seen in FIG. 7*a*, or can be slightly different in size as shown in FIG. 7*b*. For example, an offset O of the same size, i.e., same radius r, of the top and bottom bores 27, 29 will produce equal areas of ridge surface 21 and relief surface 25. However, it is also to be appreciated that a larger bottom bore 29 having a radius R relative to the top bore 27 having a smaller radius r, will create a difference in area between the ridge surface 21 and the opposing relief surface 25. Where a larger radius R bottom bore 29 is used, a larger relief surface 25 area is formed relative to the ridge surface area 21. Such an arrangement ensures sufficient clearance and relief within the die bore 11 to accommodate the tipping slug 17, whereas only a slight ridge area is generally necessary to actually initiate the tipping of the slug 17 relative to the die punch face 9. A more specific ratio range of relative size of the offset bottom bore 29, where the top bore 27 size is known for purposes of cutting the slug and hole, may be in the range of about 1 to 1.5, and more preferably in the range of 1.01 to 1.2 and even more preferably about 1.02 to 1.1.

Since certain changes may be made in the above described improved tooling die, without departing from the spirit and scope of the invention herein involved, it is intended that all of the subject matter of the above description or shown in the accompanying drawings shall be interpreted merely as examples illustrating the inventive concept herein and shall not be construed as limiting the invention.

I claim:

1. A punch and die tooling apparatus comprising:

a punch and a die for forming a hole in a metal plate;

a die body defining a vertical through bore extending between a top and a bottom surface of the die body;

a horizontally extending ridge formed on a first portion of a wall of the through bore for engaging a portion of a slug cut from the metal plate and tipping the slug away from a face of the punch;

a partially circumferential relief formed on a second portion of the wall substantially opposite from the horizontally extending ridge to facilitate the tipping of the slug away from the face of the punch wherein the partially circumferentially relief is formed vertically closer to the top surface of the die body than the horizontally extending ridge to provide an adequate space to prevent jamming of the tipping slug in the through bore of the die.

2. The punch and die tooling apparatus as set forth in claim 1, wherein the partially circumferential relief defines a relief area extending between the circumferential relief and the bottom surface of the die body.

3. The punch and die tooling apparatus as set forth in claim 1, wherein the horizontally extending ridge and the partially circumferential relief are formed by an overlapping upper and lower offset bores.

4. The punch and die tooling apparatus as set forth in claim 3, wherein the lower bore is larger than the upper bore.

* * * * *